US006070368A

United States Patent [19]

Anderson

[11] Patent Number: 6,070,368

[45] Date of Patent: Jun. 6, 2000

[54] ROOF BRACKET

[76] Inventor: Terry Elmer Anderson, 4544 W. Killarney Dr., Highland, Utah 84003

[21] Appl. No.: 09/027,553

[22] Filed: Feb. 17, 1998

[51] Int. Cl.[7] ..... E04D 13/00

[52] U.S. Cl. ..... 52/24; 52/26

[58] Field of Search ..... 52/24–26, 749.12

[56] References Cited

U.S. PATENT DOCUMENTS

| | | | |
|---|---|---|---|
| 185,137 | 12/1876 | Rogers | 52/24 |
| 302,429 | 6/1884 | Rogers | 52/24 |
| 390,061 | 9/1888 | Bower | 52/24 |
| 401,202 | 4/1889 | O'Gara | 52/24 |
| 463,235 | 11/1891 | Reimel | 52/24 |
| 511,295 | 12/1893 | Esselen | 52/24 |
| 512,179 | 1/1894 | Folsom | 52/26 |
| 591,594 | 10/1897 | Esselen | 52/26 |
| 623,988 | 5/1899 | Contant | 52/26 |
| 625,144 | 5/1899 | Clark | 52/24 |
| 649,623 | 3/1900 | Hawthorne | 52/26 |
| 654,438 | 6/1900 | Clark | 52/24 |
| 907,355 | 12/1908 | Histand | 52/26 |
| 1,222,953 | 4/1917 | Histand | 52/24 |
| 1,475,931 | 5/1923 | Campbell | 52/24 |
| 1,530,233 | 2/1925 | Campbell | 52/24 |
| 1,647,345 | 11/1927 | Douglas | 52/24 |
| 1,678,804 | 7/1928 | Ames, Jr. . | |
| 1,983,518 | 5/1934 | Buedel | 52/26 |
| 2,270,537 | 1/1942 | Ludington | 52/24 |
| 3,237,360 | 3/1966 | Mills | 52/483 |
| 3,296,750 | 1/1967 | Zaleski | 52/24 |
| 5,044,130 | 9/1991 | Chiddister | 52/24 |
| 5,070,660 | 12/1991 | Willa | 52/24 |
| 5,343,659 | 9/1994 | Zaleski | 52/24 |
| 5,349,791 | 9/1994 | Zaleski | 52/24 |
| 5,371,979 | 12/1994 | Kwiatowski | 52/24 |
| 5,669,184 | 9/1997 | Anderson | 52/26 |

FOREIGN PATENT DOCUMENTS

| | | | |
|---|---|---|---|
| 3303306 | 9/1983 | Germany | 52/24 |
| 4009164 | 9/1991 | Germany | 52/24 |
| 214656 | 8/1989 | Japan | 52/24 |
| 67347 | 3/1914 | Switzerland | 52/26 |
| 377515 | 11/1960 | Switzerland | 52/26 |

*Primary Examiner*—Beth Aubrey
*Attorney, Agent, or Firm*—Terry E. Anderson; Jim Sonntag; Tile Roof Access

[57] ABSTRACT

A snow-retaining bracket with an elongated body with a snow retention end and a roof attachment end. The snow retention end has a snow barrier means constructed and configured to inhibit sliding of snow from a roof to which the snow bracket is attached. The roof attachment end has mounting holes for attachment with a fastener to the upper surface of a roof. A cover extends over the mounting holes to cover heads of fasteners passing through the mounting holes. The cover includes structure for securing the cover without tools to the bracket.

12 Claims, 4 Drawing Sheets

ROOF BRACKET

RELATED APPLICATIONS (Not applicable)

STATEMENT REGARDING FEDERALLY SPONSORED RESEARCH OR DEVELOPMENT (Not applicable)

FIELD OF THE INVENTION

This invention relates generally to snow guards that are applied to a roof structure to inhibit the sliding of accumulated snow from the roof.

BACKGROUND OF THE INVENTION

It is well known in the art to apply brackets, stops, or fenders to a roof structure in order to prevent snow that has accumulated upon the roof from sliding from the roof. The construction of the roof brackets must not only be strong enough to hold the weight of the accumulated snow, which can be considerable, but also the bracket must not damage the roof either during installation of the bracket or while the bracket is loaded while holding the snow up on the roof.

One form of a roof bracket is disclosed in Swiss patent 305,362 to Adolph Huwiler (Huwiler). Huwiler discloses a snow bracket for use on tile roofs. The snow bracket comprises a base with a generally triangular snow-retaining portion at one end and a means for attachment to the roof at the other end. The means for attachment to the roof is essentially a downwardly extending lip that hooks over a horizontal wooden roof batten used also to support the tiles on the roof. Other snow brackets, such as that disclosed in U.S. Pat. No. 625,114, similarly rely on hooks that hook over the upper end of a shingle or slate. In U.S. Pat. No. 185,137, the end of the bracket attached to the roof is provided with a hook for hooking on a nail that secures the shingle. U.S. Pat. No. 5,349,791 discloses a snow bracket that is adhesively attached to the surface of a smooth metal roof.

It has also been proposed generally to attach snow brackets by nails or spikes that are driven directly down to the subroof. This system has been used for shingled roofs, particular for asphalt and wood singles. This system, however, is not completely satisfactory. The nails extending into the subroof may compromise the weather and water seal of the roof. To solve this problem, sealant materials are applied to the upper surfaces of the brackets or the mounting nails are covered by the course of shingles above the bracket. However, sealants are prone to failure, which can then result in a direct water path from the roof top through the subroof along the nail. Covering the mounting nails with an overlying course of shingles during the initial installation of the roof is a solution. However, a similar installation on a pre-installed roof is difficult. Individual singles must be removed to expose the surface upon which the bracket is to be installed and a new replacement single reinstalled to cover the mounting nails. Short of removing a substantial portion of a roof, any removal and reinstallation of an individual shingle must be carefully done to preserve the integrity of an overlying shingle. The result is a time consuming and often difficult process.

OBJECTS OF THE INVENTION

It is, therefore, an object of the invention to provide a snow bracket for roofs that solves the above discussed problems with the prior art.

It is also an object of the invention to provide a snow retention bracket that can be securely applied to roofs and will not cause failure of the water and weather seal of the roof.

It is also an object of the invention to provide a snow retention bracket that can be applied to roofs that have already been installed.

It is also an object of the present invention to provide a snow retention bracket that can be applied to pre-installed roofs in a manner that does not require removal any portion of the roof and will not damage the roof.

Further objects of the invention will become evident in the description below.

BRIEF SUMMARY OF THE INVENTION

The present invention is roof snow-retention bracket designed for roofs that is simple to apply to a pre-existing roof or during original roof installation. It is constructed to shield the heads of the mounting fasteners from exposure to the weather, so that the water seal does not depend solely upon the integrity of any sealant applied over the heads. In addition, the shielding allows an easy installation upon preinstalled roofs, because there are no exposed nail heads that must be covered by an overlying course of shingles or tiles.

An embodiment of the present invention is a roof snow bracket that comprises an elongated body with a retaining end and an attachment end. At the retaining end, there is a snow retainer or fender, preferably in a generally rectangular configuration, is designed to block or inhibit the sliding of snow off the roof.

The bracket is attached to a roof at the attachment end. The attachment end comprises holes for insertion of fasteners. A fastener passes through each of the mounting holes into roof and the bracket is held in place by the head of the fastener. Preferably there are two mounting holes aligned along the axis of the bracket body, but more may be provided if a stronger mount is desired. The fasteners may be any suitable fasteners, such as screws, nails, or bolts.

The mounting holes are covered by a cover. When the bracket is installed caulking compound is applied under the bracket mounting and over the heads of the fasteners. The cover is installed over the mounting holes and becomes a permanent part of the installed bracket. The cover serves to shield the fastener heads from the weather, and protects the caulking compound from degrading UV-radiation from the sun. The cover and the bracket are preferably constructed to enable an installer to easily and quickly install the cover without any special tools. Preferably the installation of the cover can be done by hand. The snow-retention brackets may be applied to any suitable roof surface, for example, asphalt shingles, wood shakes, metal roofs, tile roofs, slate roofs, and the like.

DETAILED DESCRIPTION OF THE INVENTION

Figure 1:
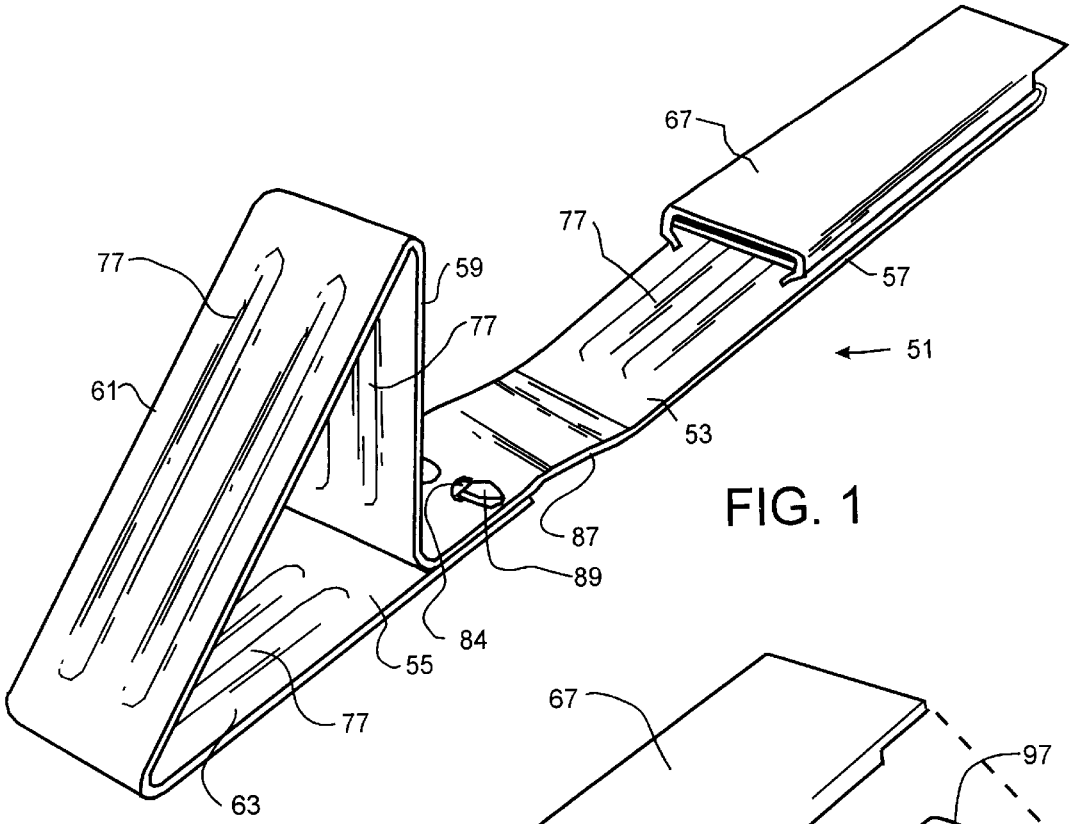
FIG. 1 is a perspective view of a snow bracket of the invention

The snow retention end comprises any suitable construction for inhibiting the slide of the snow off the roof. A preferred embodiment is formed from a metal strip for purposes of low cost and simplicity in manufacturing. The preferred snow retention end preferably comprises a generally upstanding rectangular member. The rectangular member is reinforced by a diagonal member that extends from its top to a base collinear with the bracket body. The generally triangular configuration of the rectangular snow retention member, the diagonal member and the base member can be bent from the same metal strip that comprises the base of the bracket. The strip is bent to provide all upwardly extending snow fender and then down at an angle to provide a triangular strengthening bracket and then bent again back along the axis of the base. The strip is then attached to the base by any suitable means such as bent metal pads cut from the metal strip or rivets or any other suitable method.

The roof attachment end includes structure in the form of mounting holes for mounting the bracket to the roof and structure for attaching a cover over the heads of the fasteners that attach the bracket to the roof The structure for attachment of the cover may be formed from a the same strip used to form the body and snow retention end, but is preferably formed from a thinner gauge of the same metal. A preferred attachment structure is a mounting strap that extends from the attachment end of the bracket and is bent back over the top of the attachment end. Access holes are provided in the strap for access to the mounting holes. The cover is attached by engagement with the lateral edges of the mounting strap by any suitable structure. The cover when in place covers the heads of the fasteners in the mounting holes, and is secured in place by the engagement of the cover with the strap. The mounting strap overlying the mounting holes provides lateral edges for which it is relatively simple to provide firm attachment of the cover with easy installation. This embodiment is illustrated below in FIGS. 1 to 3.

In an alternate embodiment, the cover may be secured by directly engaging edges of the attachment end. This embodiment is less preferred, because it is more difficult than in the overlying strap design to provide a firm attachment of the cover while having an easy application of the cover by the installer. However, for short brackets, this design may be required if there is insufficient length for an overlying mounting strap.

The snow bracket invention also may comprise suitable ribs and like to stiffen the various components of the bracket. For example, stiffening ribs along the body can be stamped into the metal strip to prevent bowing or flexure of the body under a snow load. In addition, at the juncture of the retaining member with the body an indented gusset may be provided to provide strength at those joints and to inhibit bending under a snow load.

Another advantage of the present invention is its relative simplicity of manufacture. The bracket and cover can each be stamped and bent from a single flat piece of metal. The bracket can be stiffened and strengthened by applying ribs during the stamping operation, enabling fabrication from relatively thin gauges of metal.

Referring to FIGS. 1, 2, 2*a* and 3, the snow bracket of the invention, generally designated 51, comprises an elongated body 53 with a snow retention end 55 and a roof attachment end 57. The elongated body 53, is generally flat and strap-like, to permit it to be easily laid flat upon a roof. At or near the snow retention end 55 is an upwardly extending snow dam or barrier member 59 that functions to prevent snow from sliding from a roof upon which the snow bracket is installed. In the illustrated embodiment, the barrier member 59 extends upwardly and perpendicularly from the elongated body 53 to present a surface against the sliding of snow. A diagonal brace member 61 extends from the top of the barrier member 59 to a base member that is essentially a collinear extension of the elongated body at the snow retention end 55.

Figure 2:
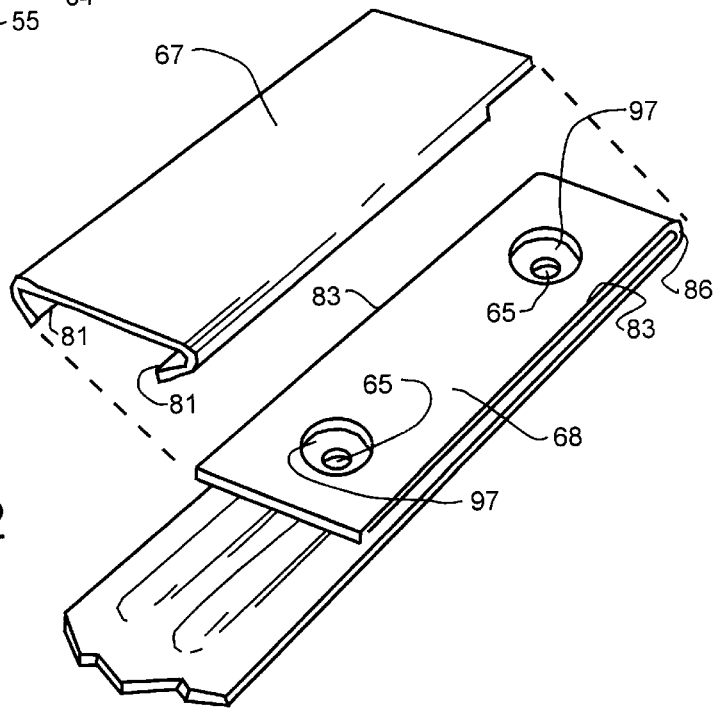
FIG. 2 is an exploded detail of the retainer end of the snow bracket of FIG. 1.
Figure 2A:
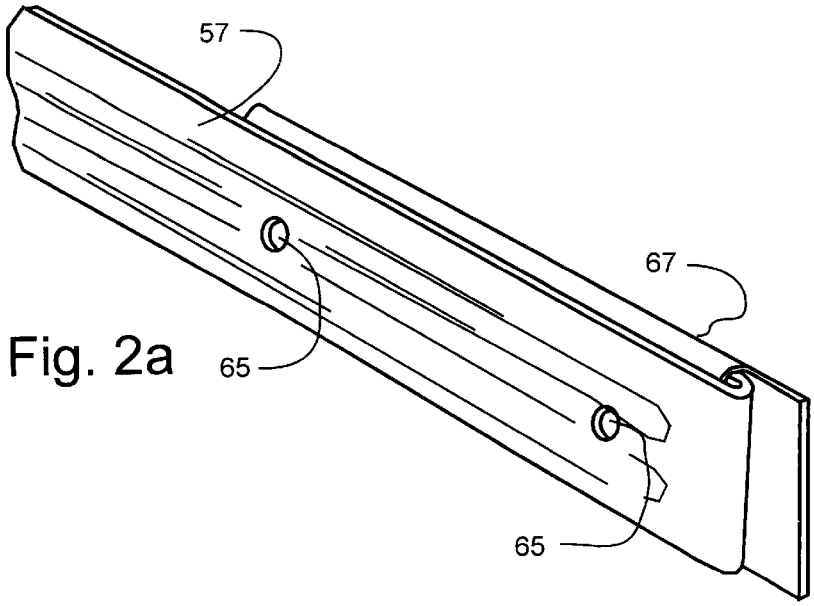
FIG. 2*a* is a detail of the underside of the retainer end of the snow bracket of FIG. 1.

The attachment end 57 comprises mounting holes 65 and a cover 67 (See FIG. 2*a*). The cover is attached to the bracket by lips 81 at the lateral edges of the cover, which engage lateral edges 83 of a mounting strap 68 attached to attachment end 57. The mounting strap 68 is constructed by bending over an extension of the attachment end, as best illustrated in FIG. 2. The U-bend 86 thus formed provides a stop against which the lips of the cover 67 abut when the cover is installed. Access holes 97 are provided in the mounting strap 68 for access to the mounting holes 65. The cover 67 is attached by sliding the cover onto the mounting strap 68 from the center of the bracket toward the attachment end, as shown by the arrows in FIGS. 1 and 3.

Figure 4:
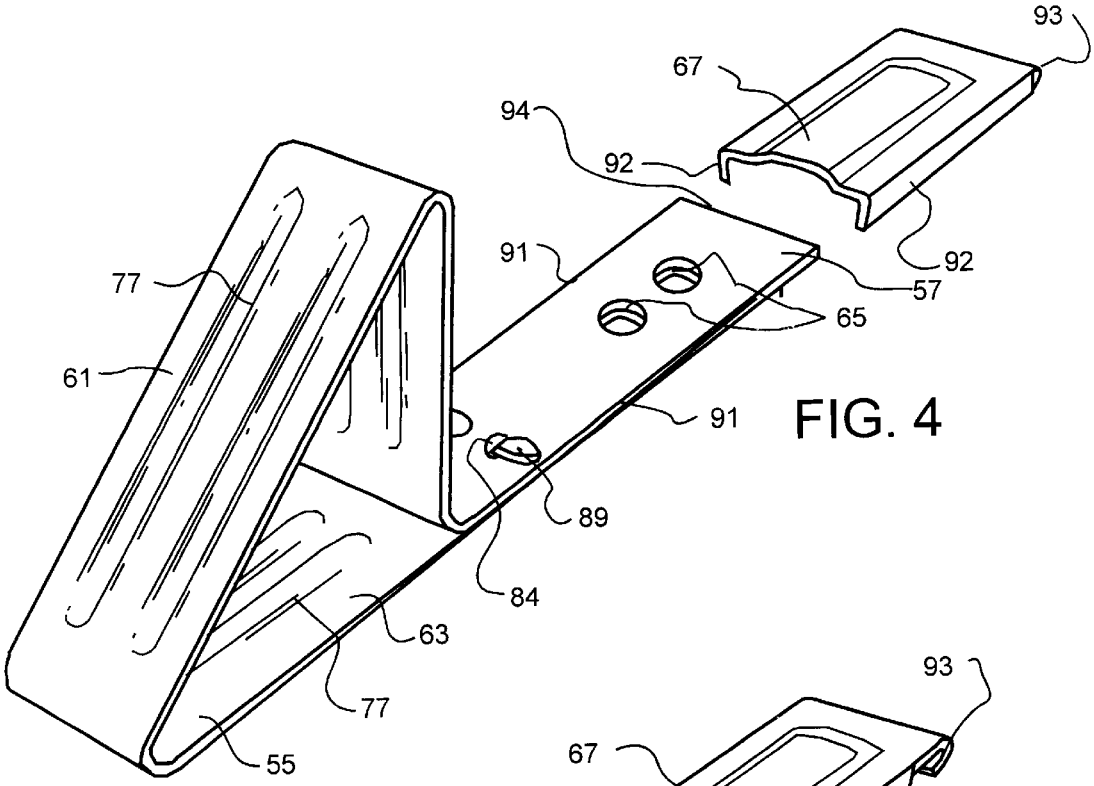
FIG. 4 is a perspective view of an other snow bracket of the invention.
Figure 4A:
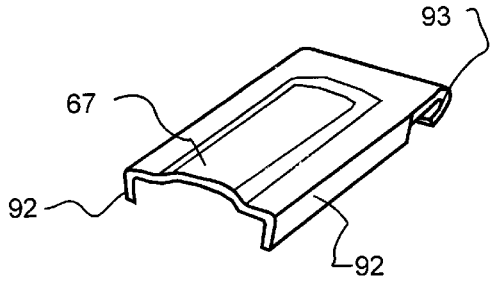
FIG. 4*a* is a detail view in partial cross-section of the cover of FIG. 4.

Other constructions of cover and the structure for its attachment are contemplated. For example, referring to FIG. 4, the attachment end 57 of the bracket comprises mounting holes 65, and a cover 67 is constructed to engages edges of the attachment end 57. Referring also to FIG. 4*a*, the cover comprises lateral panels 92 on the lateral edges that engage the lateral edges 91 of the attachment end 57. A hook attachment 93 at the distal end of the cover, engages the distal end 94 of the attachment end 57, to assist in securing the cover. FIG. 4*a*, shows a partial section of a lateral panel 92 to better show the hook 93. The cover is also secured by caulking compound (not shown) that is placed over the heads of fasteners in the mounting holes before fastening the cover.

To stiffen the bracket member stiffening ribs that extend along the long axis of the members may be provided. These include ribs 77 in the elongated body, the bottom member, the diagonal member, and the snow retention member.

The snow bracket of the invention is preferably constructed from a single piece in the form of a long, narrow strip. The strip is preferably of a suitable sheet metal, such as steel, galvanized steel, copper, brass, or any other suitable sheet material with suitable rust and corrosion resistance, with the suitable strength required to retain snow upon the roof, and with suitable malleability to enable formation of the snow bracket by bending. The cover is preferably made from the same metal as the bracket of a thinner gauge. For corrosion resistance and for visual appearance of the bracket, a suitable coating may be applied to the bracket and cover.

The snow bracket 51 is manufactured by bending the sheet metal strip at the appropriate places to form the shape illustrated in the figures. The cover 67 is likewise formed from sheet metal by stamping and bending. The ribs 77 may be form by known methods, such as stamping, or the like. At the snow retention end 55, after forming the triangle of the barrier 59, diagonal 61, and base members 63, the end of the strip is attached to the body 53 of the snow bracket by appropriate means such as by rivets, or by tabs 89 that are punched from the strip near the strip end and extended through tab holes 84 in the elongated body and bent over to hold the strip end to the elongated body 53, as illustrated. The elongated body is bent or indented slightly upward at 87 to provide a more flat surface on the underside of the snow bracket 51.

For the snow bracket in FIGS. 1, 2, 2*a*, and 3, the attachment end is formed by punching the mounting holes 65 and access holes 97 and bending up the attachment end to form the mounting strap 68. For the snow bracket of FIG. 4, mounting holes are drilled into the mounting end after the retention end is formed.

The cutting of the strips and the cutouts, the bending of the strip, and the forming of the reinforcing ribs may be accomplished in any order by any suitable means used in metal fabrication.

The snow bracket may be installed during construction of a roof, or it may be installed upon a preexisting roof. If the snow bracket is being installed during construction of, for example, a shingled roof, the snow bracket is placed over an underlying shingle and fastened with suitable fasteners. The course above the bracket can then be installed.

For application of the bracket upon preinstalled shingles, the bracket is placed upon a shingle, and preferably butted up against the bottom edge of the shingle of the overlying course. The cover is then applied.

Installation on other roofing surfaces, such as on tiles, metal roofs, slate roofs, etc. is accomplished in a similar manner. For any installation, there is no need for removal of shingles, tiles, or the like, to install the roof brackets.

When the bracket is fastened to a roof surface, suitable sealing or caulking compounds may be applied upon the roof surface and on the underside of the bracket before securing the bracket upon the roof surface. Sealing or caulking compounds are also applied over the nails or fasteners before installation of the cover.

Figure 3:
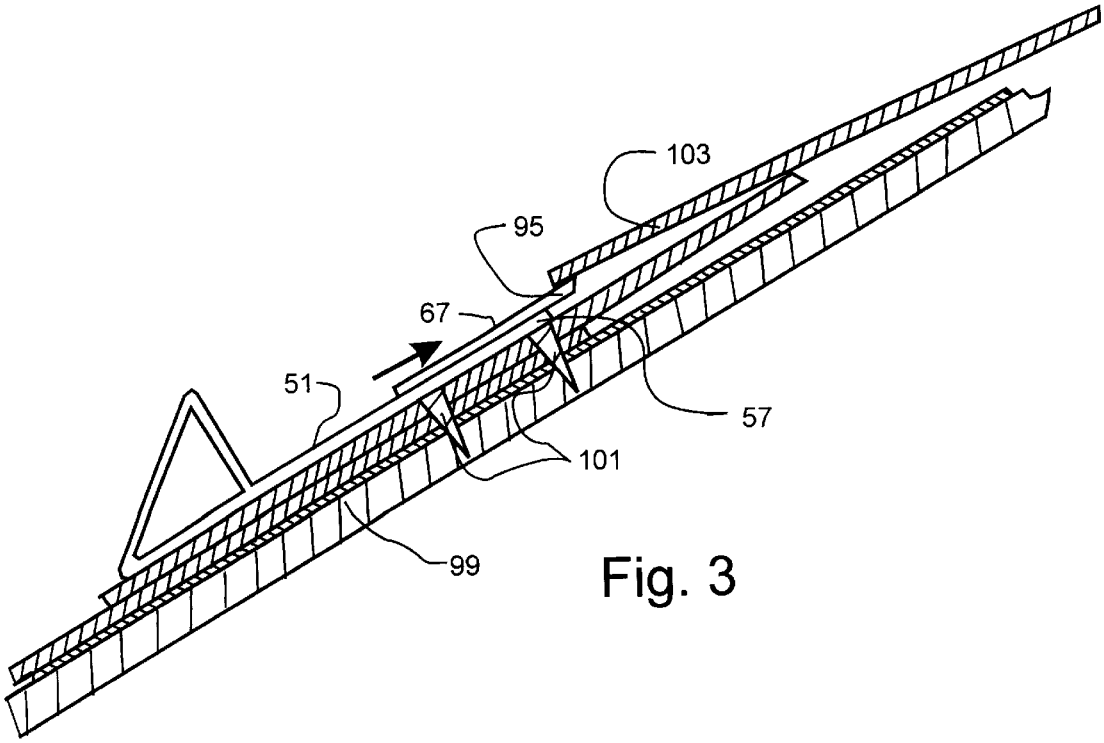
FIG. 3 is a cross-section of a snow bracket of the invention installed upon a roof.

Referring to FIG. 3, which is cross-section of a bracket 51 with cover 67 constructed as in FIGS. 1, 2, and 2*a*, which is installed upon a shingled roof 99. After fastening down the bracket with fasteners 101, the cover is slid upon the bracket as shown by the arrow. An extension 95 at the distal end of the cover extends beyond the attachment end 57 of the bracket and under the end of the overlying shingle 103. During application, the end of the shingle 103 is slightly raised to allow the extension to by slid under the shingle when the cover is installed. The extension 95 provides an additional weather protection by preventing water flowing from the top of the overlying shingle from flowing under the bracket. If this bracket is installed while constructing the roof, the installation may be same after installation of the overlying course of shingles or the bracket may be applied first and the overlying shingles applied to slightly overlap the extension on the attachment end. The extension 95 is optional, and the bracket may be constructed to merely abut against the overlying shingle.

Figure 5:
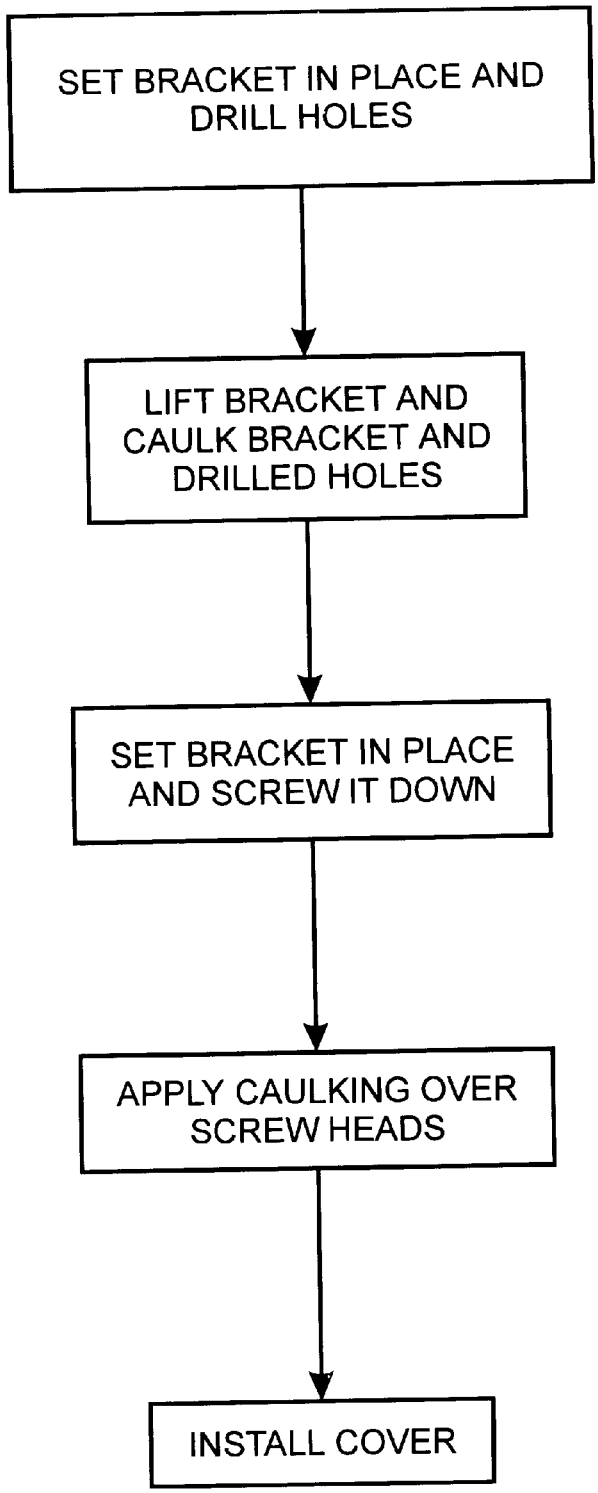
FIG. 5 is a flow sheet of a method of invention for installing snow-retention brackets.

Referring to FIG. 5, which is a flow sheet showing installation of a bracket of the invention. The bracket is set in place and holes are drilled in the roof, using the mounting holes in the bracket as guides. The bracket is lifted from the roof and caulking compound is applied to the drilled holes and the bottom of the bracket. The bracket is then set in place and screws inserted through the mounting holes and the caulking compound and screwed down into the drilled holes until the heads hold the bracket securely. Screws are the preferred fastener, but nails, bolts and any other suitable fastener are contemplated. Caulking compound is then spread over the screw heads and the cover is secured over the caulked screw heads. The caulking compound serves to seal the attachment and assists is securing the cover to the bracket. The cover 67 may by constructed with an upwardly or convex surface to provide a cavity for the fastener heads and for caulking compound or sealant, as illustrated in FIGS. 4 and 4*a*.

The dimensions of the snow bracket are those appropriate for the roof type and the length of the shingle or tile to which it is applied. In preferred practice, the length of the bracket is approximately the length of the exposed portion of the roofing material. For example, usually about 5½ inches of a shingle is exposed, the remaining being covered by the overlying shingles. For, this application, a short bracket of approximately that length, preferably of the configuration shown in FIG. 4. For wood shingles or shakes, the exposed length of the shingle and thus the bracket length in usually about 9½ inches long, using a bracket construction as shown in FIG. 1. For tile, slate, and flat seam metal roofs, the length is about 11 ½ inches using a construction as shown in FIG. 1. For standing seam metal and metal panel roofs, the length is not critical, but short brackets, such as those used on asphalt roofs, have been found suitable. For all of the brackets, the snow barrier is about 3 inches high.

The snow retention end illustrated in the FIGS. 1, 2, and 2*a* is preferred because of its ease of manufacture from an elongated piece of sheet metal. However, other snow retention means at the snow retention end may also be applied to the snow bracket of the invention without departing from the scope of the claims. In addition, the snow bracket may be manufactured by other suitable means, such as casting from metal, or molding from a suitable high-strength polymeric material, or assembling from parts of dissimilar materials. The cover and the bracket may be the same or different material. For example, the bracket may be a metal and the cover of a molded polymeric material or the same metal as the bracket.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. A snow-retaining bracket comprising an elongated body with a snow retention end and a roof attachment end, the snow retention end having a snow barrier means constructed and configured to inhibit sliding of snow from a roof to which the snow-retraining bracket is attached, the roof attachment end comprising mounting holes for attachment with a fastener therethrough to an upper surface of the roof, a cover extending over the mounting holes to cover fasteners passing through the mounting holes, the cover including a structure for securing the cover to the bracket.

2. A snow-retaining bracket as in claim 1 wherein the structure for securing the cover comprises a mounting strap fixed to the attachment end and extending over the mounting holes with lateral edges adapted to engage lips on lateral edges of the cover to secure the cover to the mounting strap, and access holes disposed in the mounting strap to allow fasteners to be inserted through the mounting holes.

3. A snow-retaining bracket as in claim 1 wherein the structure for securing the cover comprises a structure on lateral edges of the cover for engaging lateral edges of the attachment end.

4. A snow-retaining bracket as in claim 1 wherein the structure for securing the cover comprises a structure on lateral edges of the cover for engaging lateral edges of the attachment end and a structure on a distal end of the cover for engaging a distal portion of the attachment end.

5. A snow-retaining bracket as in claim 1 wherein the bracket and the cover are constructed to retain a sealant over the fasteners with the cover secured over the sealant.

6. A snow-retaining bracket comprising an elongated body with a snow retention end and a roof attachment end, the snow retention end having a snow barrier means constructed and configured to inhibit sliding of snow from a roof to which the snow retaining-bracket is attached, the roof attachment end comprising mounting holes for attachment with fasteners therethrough to an upper surface of the roof, a cover extending over the mounting holes to cover fasteners passing through the mounting holes, the cover including a mounting strap fixed to the attachment end and extending over the mounting holes with lateral edges adapted to engage lips on lateral edges of the cover to secure the cover to the mounting strap.

7. A snow-retaining bracket as in claim 6 wherein the cover is secured to the mounting strap by a sliding engagement of the cover onto the mounting strap.

8. A snow-retaining bracket as in claim 7 wherein the sliding engagement is in the direction toward the attachment end with the lips engaging the lateral edges of the mounting strap and the lips abutting the attachment end at the attachment of the mounting strap to the attachment end to prevent further sliding in the direction toward the attachment end.

9. A snow-retaining bracket as in claim 6 wherein the cover comprises access holes to permit insertion of fasteners through the access holes and through the mounting holes.

10. A snow-retaining bracket as in claim 6 wherein the upper roof surface is an upper surface of a shingled roof.

11. A snow-retaining bracket as in claim 10 wherein the cover includes an extended portion adapted to extend under a lip of a shingle of the shingled roof that overlies a shingle upon which the bracket is attached.

12. A snow-retaining bracket as in claim 6 wherein the fasteners are at least one of screws, nails, and bolts.

* * * * *